US007040792B2

(12) United States Patent
Brandenburg et al.

(10) Patent No.: US 7,040,792 B2
(45) Date of Patent: May 9, 2006

(54) LIGHT-EMITTING DIODE MODULE FOR A VEHICLE HEADLAMP, AND A VEHICLE HEADLAMP

(75) Inventors: Wilhelm Brandenburg, Paderborn (DE); Oliver Hering, Niederstotzingen (DE); Thomas Reiners, Bachhagel (DE)

(73) Assignee: Patent-Treuhand-Gesellschaft fur Elektrische Gluhlampen mbH, Munich (DE)

( * ) Notice: Subject to any disclaimer, the term of this patent is extended or adjusted under 35 U.S.C. 154(b) by 92 days.

(21) Appl. No.: 10/890,300

(22) Filed: Jul. 14, 2004

(65) Prior Publication Data

US 2005/0047169 A1 Mar. 3, 2005

(30) Foreign Application Priority Data

Jul. 24, 2003 (DE) ..... 103 33 837

(51) Int. Cl.
*F21S 8/10* (2006.01)
*F21V 7/04* (2006.01)

(52) U.S. Cl. ..... 362/545; 362/240; 362/247; 362/249; 362/800

(58) Field of Classification Search ..... 362/543–545, 362/241, 247, 240, 245, 249, 252, 800
See application file for complete search history.

(56) References Cited

U.S. PATENT DOCUMENTS

| | | | | |
|---|---|---|---|---|
| 5,561,346 | A * | 10/1996 | Byrne | 362/252 |
| 6,520,669 | B1 * | 2/2003 | Chen et al. | 362/545 |
| 6,601,982 | B1 | 8/2003 | Begemann et al. | 362/545 |
| 6,637,921 | B1 | 10/2003 | Coushaine | 362/517 |
| 6,676,282 | B1 | 1/2004 | Begemann et al. | 362/543 |
| 6,682,211 | B1 * | 1/2004 | English et al. | 362/545 |
| 6,793,372 | B1 * | 9/2004 | Wehner et al. | 362/247 |
| 6,871,993 | B1 * | 3/2005 | Hecht | 362/241 |
| 2003/0063474 | A1 | 4/2003 | Coushaine | 362/517 |
| 2003/0067786 | A1 | 4/2003 | Begemann et al. | 362/543 |
| 2003/0103348 | A1 * | 6/2003 | Hung | 362/247 |

FOREIGN PATENT DOCUMENTS

| | | |
|---|---|---|
| EP | 1 298 382 A1 | 9/2001 |
| WO | 01/01037 A1 | 6/1999 |

* cited by examiner

*Primary Examiner*—Alan Cariaso
(74) *Attorney, Agent, or Firm*—William E. Meyer

(57) ABSTRACT

The invention relates to a light-emitting diode module for a vehicle headlamp, the carrier of which module has cambered surfaces on which the light-emitting diodes are arranged, and to a vehicle headlamp which is fitted with one or more of these light emitting diode modules, in order to generate the dimmed headlight, high beam, fog lamp, parking light or daytime running light exclusively using light-emitting diodes as light sources.

4 Claims, 4 Drawing Sheets

LIGHT-EMITTING DIODE MODULE FOR A VEHICLE HEADLAMP, AND A VEHICLE HEADLAMP

I. TECHNICAL FIELD

Figure 1:
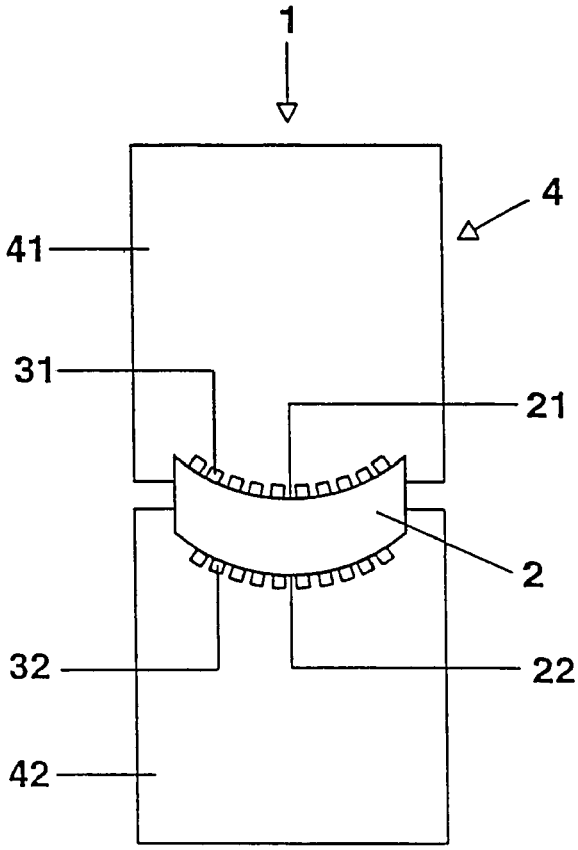

The invention relates to a light-emitting diode module for a vehicle headlamp in accordance with the preamble of patent claim 1, and to a vehicle headlamp in accordance with the preamble of patent claim 9.

II. BACKGROUND ART

The laid-open specification WO 01/01037 A1 discloses a vehicle headlamp with a multiplicity of light-emitting diodes serving as light source. The light bundle emitted by the light-emitting diodes has at least two segments with light from different spectral regions. A first segment of the light bundle has a high proportion of white or yellow-orange light, and a second segment has a high proportion of blue-green light.

The laid-open specification EP 1 298 382 A1 describes a light-emitting diode module for a vehicle luminaire having a reflector and a carrier for light-emitting diodes, the carrier having a plane surface on which the light-emitting diodes are arranged.

III. DISCLOSURE OF THE INVENTION

It is the object of the invention to provide a light-emitting diode module for a vehicle headlamp that is suitable for producing various light distributions typical of a vehicle headlamp. Moreover, it is the object of the invention to provide a vehicle headlamp that permits the production of the typical light distributions of a vehicle headlamp solely with the aid of light-emitting diodes as light sources.

This object is achieved by a light-emitting diode module for a vehicle headlamp, the light-emitting diode module having a reflector and a carrier for light-emitting diodes, and the carrier having at least one surface region on which a number of light-emitting diodes are arranged, wherein the light-emitting diodes are arranged along at least one curved line on said at least one surface region. Particularly advantageous designs of the invention are described in the dependent patent claims.

The light-emitting diode module according to the invention for a vehicle headlamp has a reflector and a carrier for light-emitting diodes, the carrier having at least one surface region on which a number of light-emitting diodes are arranged according to the invention along at least one curved line. The light-emitting diode module according to the invention permits the shape of the spatially extended light source, which here comprises a multiplicity of light-emitting diodes, to be optimally adapted to the reflector. It has emerged that the light-emitting diode module according to the invention can be used to implement different light distributions for a vehicle headlamp. For example, the light-emitting diode module according to the invention can be used in a vehicle headlamp to produce the light distributions for fog lamp, dimmed headlight, high beam, parking light or daytime running light. In order to produce the comparatively complex, asymmetric light distribution of the parking light, for example, only three of the inventive light-emitting diode modules in a vehicle headlamp are required.

The at least one curved line along which the light-emitting diodes are arranged advantageously corresponds to a segment of a conic section, preferably an ellipse, in order to permit optimum adaptation to a freeform surface reflector. The at least one surface region of the carrier on which the light-emitting diodes are mounted advantageously has a longitudinal extent oriented transverse to the optical axis of the reflector such that the at least one curved line along which the light-emitting diodes are arranged extends substantially transverse to the optical axis of the reflector. The above named at least one surface region is preferably inclined to the optical axis of the reflector such that it faces a light reflecting face of the reflector so that as large as possible a proportion of the light emitted by the light-emitting diodes strikes the reflector. The at least one surface region can be of plane or cambered design. In the latter case the curvature of the at least one line along which the light-emitting diodes are arranged is preferably determined by the camber of the at least one surface region.

The at least one surface region preferably has a longitudinal extent oriented transverse to the optical axis of the reflector, is of cambered design in the direction of its longitudinal extent and is inclined to the optical axis such that it faces a light reflecting face of the reflector. The cambered design of the above named surface region is to be understood such that this cambered surface region can also be of faceted design, that is to say can consist of a multiplicity of flat facets, in order to ensure that in each case a flat subarea is available for mounting the light-emitting diodes. Each light-emitting diode can, for example, be fixed on a facet, the size of the facet being coordinated with the dimensions of the light-emitting diode fixed thereon. The camber of the above named at least one surface region advantageously corresponds to a conic section and is preferably of elliptical design. The light-emitting diodes mounted on this surface region are advantageously arranged along a line that corresponds to a conic section and preferably to the section of an ellipse. The contour of the light source thereby obtained, which is in the shape of a conic section and preferably elliptical, can advantageously be combined with a freeform surface reflector in order to generate the light distributions typical of vehicle headlamps.

In accordance with the preferred exemplary embodiment of the invention, the carrier of the light-emitting diode module has two surface regions on which in each case a number of light-emitting diodes are arranged, a first surface region being concavely cambered and the second surface region being convexly cambered, and case the concavely cambered first surface region facing a first light reflecting face of the reflector, and the convexly cambered second surface region facing the second light reflecting face of the reflector. The diodes arranged on the two differently cambered surfaces can be combined optimally with a freeform surface reflector consisting of two halves. In particular, this diode arrangement can be used to produce a sharp light/dark boundary for the typical light distribution of the vehicle headlamp, in particular for the dimmed headlight. Moreover, the luminous flux and the luminous intensity of the light-emitting diode module are increased by the second surface, fitted with light-emitting diodes, of the carrier and by the second light reflecting face of the reflector.

The vehicle headlamp according to the invention comprises at least one light-emitting diode module that has a reflector and a carrier for light-emitting diodes, the carrier having at least one surface region on which a number of light-emitting diodes are arranged according to the invention along at least one curved line. The at least one light-emitting diode module arranged in the vehicle headlamp according to the invention has the advantageous features already explained above.

The vehicle headlamp according to the invention, which exclusively contains light-emitting diodes as light sources, can be used to produce the same light distributions as with the aid of the conventional vehicle headlamps that are fitted with incandescent lamps or discharge lamps. In particular, a vehicle headlamp according to the invention, which contains only one light-emitting diode module, can be used to generate the parking light, for example. The light distributions of fog lamp, daytime running light or high beam can be produced, for example, with the aid of a vehicle headlamp according to the invention that contains two inventive light-emitting diode modules arranged next to one another. If a higher luminous flux or a higher luminous intensity is required, however, it is also possible to mount more than two inventive light-emitting diode modules in the vehicle headlamp. In order to produce the asymmetric light distribution of the dimmed headlight, the vehicle headlamp preferably contains at least three inventive light-emitting diode modules. The first light-emitting diode module is preferably used to produce a first, widespread light distribution whose maximum luminous intensity forms a narrow strip along the light/dark boundary of the light distribution. The second light-emitting diode module can preferably be used to produce a second light distribution directed onto a point, whose maximum luminous intensity is localized at a central point on the light/dark boundary of the light distribution. The illumination of the edge of the roadway averted from the oncoming traffic is preferably ensured by means of a third light-emitting diode module in the vehicle headlamp that serves to produce an asymmetric light distribution, the so-called 15 degrees asymmetric finger of the dimmed headlight distribution. The light distributions of the three modules of the vehicle headlamp are superimposed and together produce the dimmed headlight distribution. If a higher luminous flux or a higher luminous intensity are desired, it is also possible for more than three inventive light-emitting diode modules to be arranged in the vehicle headlamp.

IV. BRIEF DESCRIPTION OF THE DRAWINGS

Figure 2:
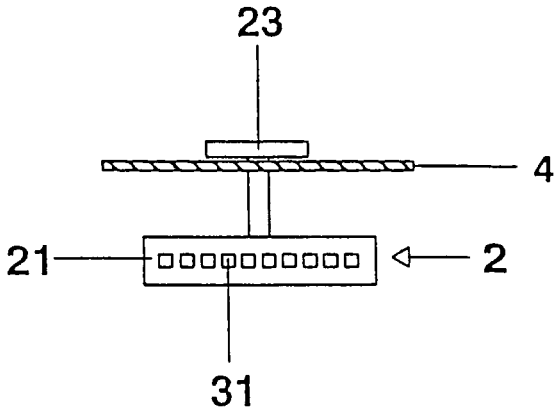
Figure 3:
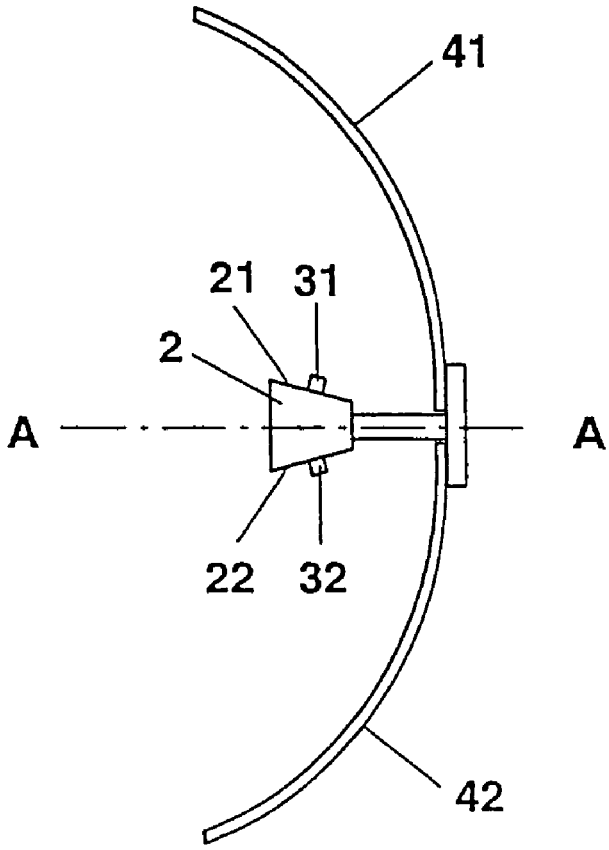
Figure 4:
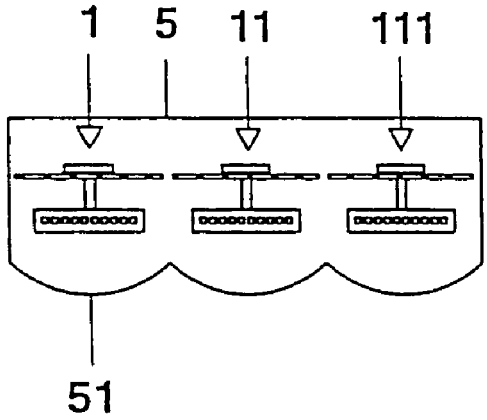
Figure 5:
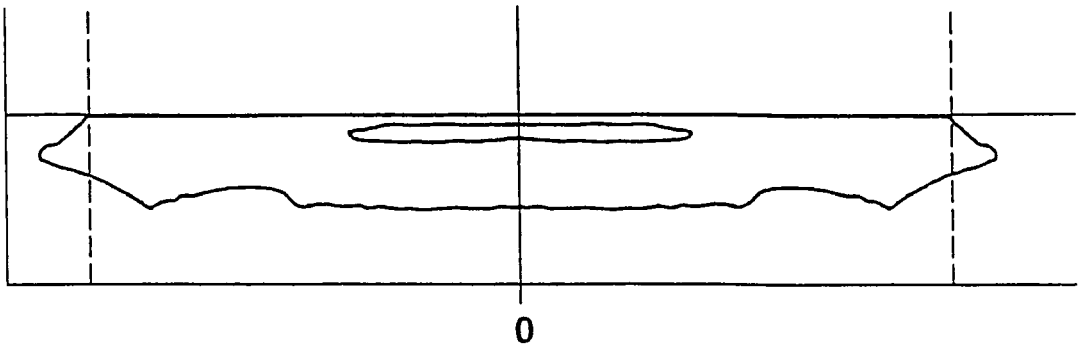
Figure 6:
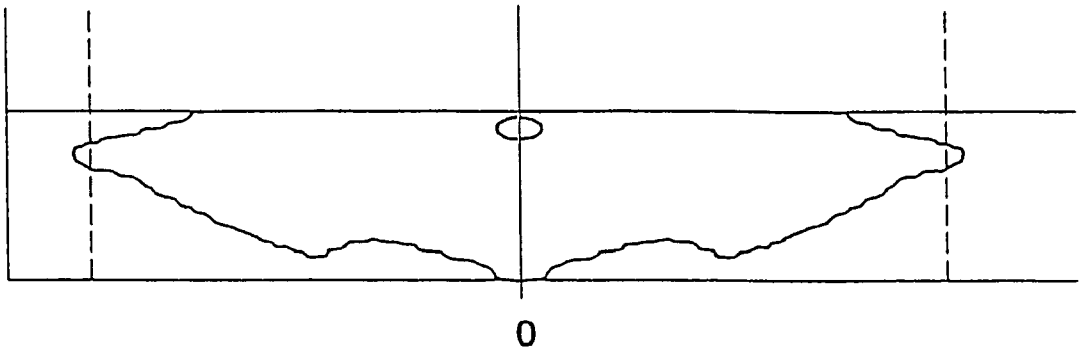
Figure 7:
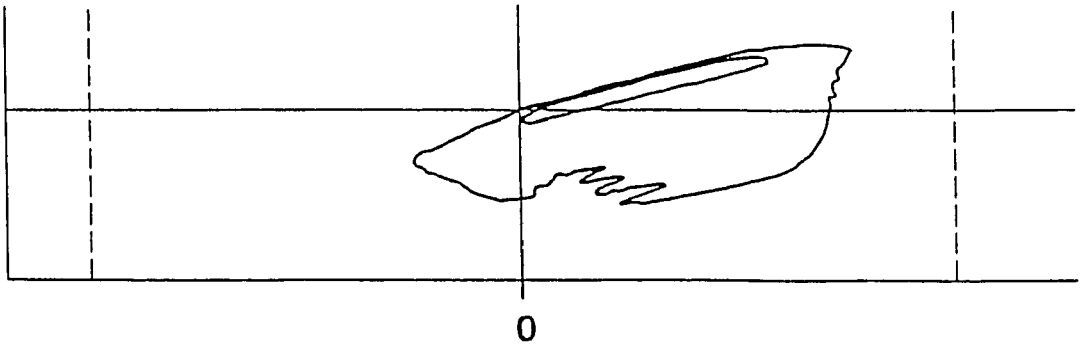
Figure 8:
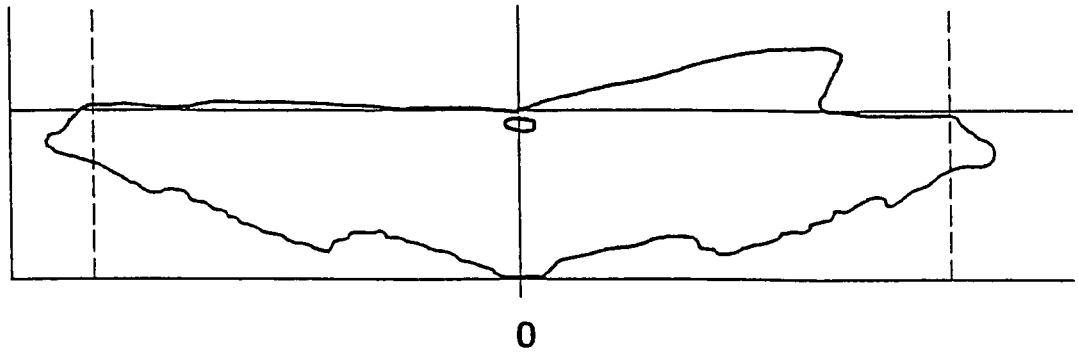
Figure 9:
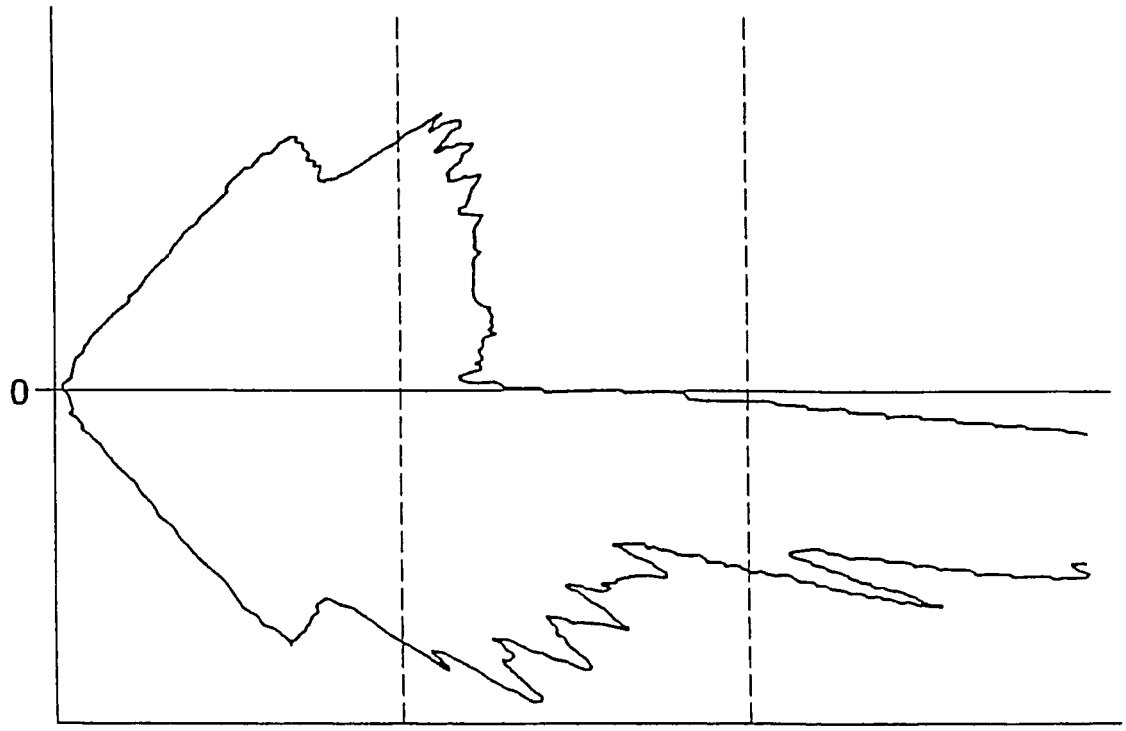

The invention will be explained in more detail below with the aid of a preferred exemplary embodiment. In the drawing:

FIG. 1 shows a schematic of a front view of a light-emitting diode module in accordance with a preferred exemplary embodiment of the invention, FIG. 2 shows a plan view of the light-emitting diode module depicted in FIG. 1, in a partially sectioned illustration, FIG. 3 shows a side view of the light-emitting diode module depicted in FIG. 1, FIG. 4 shows a schematic of a plan view of a vehicle headlamp in accordance with a preferred exemplary embodiment of the invention, FIG. 5 shows the light distribution of the first light-emitting diode module of the vehicle headlamp from FIG. 4, FIG. 6 shows the light distribution of the second light-emitting diode module of the vehicle headlamp from FIG. 4, FIG. 7 shows the light distribution of the third light-emitting diode module of the vehicle headlamp from FIG. 4, FIG. 8 shows the total dimmed headlight distribution of the vehicle headlamp depicted in FIG. 4, and FIG. 9 shows the total dimmed headlight distribution of the vehicle headlamp depicted in FIG. 4, in a bird's-eye view.

V. BEST MODE FOR CARRYING OUT THE INVENTION

FIGS. 1 to 3 schematically depict an exemplary embodiment of the light-emitting diode module according to the invention. The light-emitting diode module 1 has a carrier 2 for a total of twenty light-emitting diodes) preferably light-emitting diodes 31, 32, that produce white light during operation, and a freeform surface reflector 4 that has two light reflecting faces 41, 42. However, it is also possible to use laser diodes instead of light-emitting diodes. The carrier 2 consists of a material of high thermal conductivity, for example of a metal or plastic, in order to dissipate the heat generated by the light-emitting diodes 31, 32. The carrier 2 has a first, concavely cambered surface 21 that faces the first light reflecting face 41 of the reflector 4 and on which ten light-emitting diodes 31 are arranged in series next to one another. The concave camber of the surface 21 of the carrier 2 extends transverse to the optical axis A—A of the reflector 4. In addition, the carrier 2 has a second, convexly cambered surface 22 that faces the second light reflecting face 42 of the reflector 4 and on which ten light-emitting diodes 32 are likewise arranged in series next to one another. The cambered surfaces 21, 22 are inclined to the optical axis A—A of the reflector 4 in the direction of the light reflecting faces 41 and 42 such that the light emitted by the light-emitting diodes 31, 32 strikes the first 41 or second light reflecting face 42, respectively, of the reflector 4. The camber of the two surfaces 21, 22 is elliptical. The light-emitting diodes 31 and 32 are therefore respectively arranged along a segment of an ellipse. The surfaces 21, 22 can be of faceted design such that each light-emitting diode 31, 32 is arranged on a flat surface segment. The shape of the carrier 2 and of the surfaces 21, 22 is illustrated in FIGS. 1 and 3. The head of the carrier 2, on which the light-emitting diodes 31, 32 are arranged, approximately has the shape of a sickle or banana. The carrier 2 has a base 23 for mounting the light-emitting diode module 1 in a headlamp 5. The base 23 also comprises the means for the light-emitting diodes 31, 32 to make electrical contact, and can, for example, additionally have a heat sink designed as a metal disk provided with cooling ribs, in order to dissipate the heat generated by the light-emitting diodes 31, 32 via the material of the carrier 2 and the base 23. The light-emitting diode module 1 has a width of 40 mm and a height of 80 mm. The head of the carrier 2, fitted with the light-emitting diodes 31, 32, is arranged at a distance of 10 mm from the apex of the reflector 4. Each of the twenty light-emitting diodes 31, 32 has a luminous flux of 10 lm such that the total luminous flux of the light-emitting diode module is 200 lm. The luminous intensity of the light-emitting diode module 1 can be further substantially improved in the use of more powerful light-emitting diodes, or by mounting a second row of light-emitting diodes on the surfaces 21, 22.

FIG. 4 schematically depicts a vehicle headlamp 5 in accordance with an exemplary embodiment of the invention, that is equipped with three light-emitting diode modules 1, 11, 111 arranged next to one another. All the light-emitting diode modules 1, 11, 111 have the above described design illustrated schematically in FIGS. 1 to 3. They differ from one another essentially only in the shape of the light reflecting faces of their reflectors. In the case of the module 111, the distance of the head of the carrier fitted with the light-emitting diodes from the apex of the reflector is additionally 25 mm instead of the above described 10 mm. This state of affairs is illustrated schematically in FIG. 4. The vehicle headlamp 5 has a transparent front cover 51 that can be designed as an optical lens. It serves for producing the dimmed headlight of a motor vehicle. The vehicle headlamp 5 produces a luminous flux of 600 lm. The luminous flux can be improved to a value of 1200 lm or more by doubling the number of the light-emitting diodes or the number of the light-emitting diode modules, or else by using more powerful light-emitting diodes.

The light distributions generated by the light-emitting diode modules 1, 11, 111 are illustrated schematically in FIGS. 5 to 8. These figures show the projection of the light emitted by the light-emitting diode modules 1, 11 and 111 onto a vertically arranged screen. The first light-emitting diode module 1 produces a light distribution that is widespread along the light/dark boundary of the dimmed headlight and largely has mirror symmetry with reference to the vertical plane 0. The brightness maximum is located in a narrow strip along horizontally running light/dark boundaries. The second light-emitting diode module 11 generates a light distribution which is focused onto a point and likewise largely has mirror symmetry with reference to the vertical plane 0. Its brightness maximum is located on the light/dark boundary, at the center. The third light-emitting diode module 111 serves to produce an asymmetric light distribution, in particular for producing the asymmetric finger of the dimmed headlight distribution. It is required for illuminating the edge of the roadway averted from the oncoming traffic. The brightness maximum of the asymmetric light distribution extends along a narrow strip that forms an angle of approximately 15 degrees with the horizontal. The total light distribution generated by the vehicle headlamp 5 is depicted in FIGS. 8 and 9.

The invention is not limited to the exemplary embodiment explained above in more detail. Any other desired light distributions, for example for the fog lamp, high beam, parking light or daytime running light can be produced by suitable combinations of a number of the inventive light-emitting diode modules and appropriate adaptation of the reflector shape. It is also possible to use only one of the inventive light-emitting diode modules in the vehicle headlamp to produce the abovementioned light distributions when an adequately high number of light-emitting diodes are mounted on the carrier of the light-emitting diode module, and/or light-emitting diodes with an adequately high luminous flux are arranged on the carrier of the light-emitting diode module, and the reflector shape is appropriately adapted to the desired light distribution.

What is claimed is:

1. A light-emitting diode module for a vehicle headlamp, the light-emitting diode module having a reflector and a carrier for light-emitting diodes, and the carrier having at least one surface region on which a number of light-emitting diodes are arranged, wherein the light-emitting diodes are arranged along at least one curved line on said at least one surface region, wherein said at least one surface region has a longitudinal extent oriented transverse to the optical axis of the reflector and is of cambered design in the direction of its longitudinal extent, and wherein the carrier has two surface regions on which in each case a number of light-emitting diodes are arranged, a first surface region being concavely cambered, and the second surface region being convexly cambered, and the concavely cambered first surface region facing a first light-reflecting face of the reflector, and the convexly cambered second surface region facing a second light-reflecting facing of the reflector.

2. A vehicle headlamp having at least one light-emitting diode module, said at least one light-emitting diode module having a reflector and a carrier for light-emitting diodes, and said carrier having at least one surface region on which a number of light-emitting diodes are arranged, wherein said light-emitting diodes are arranged along at least one curved line on said at least one surface region wherein said at least one surface region has a longitudinal extent oriented transverse to the optical axis of said reflector, and is of cambered design in the direction of its longitudinal extent, and wherein the carrier has two surface regions on which in each case a number of light-emitting diodes are arranged, a first surface region being concavely cambered, and the second surface region being convexly cambered, and the concavely cambered first surface region facing a first light-reflecting face of the reflector, and the convexly cambered second surface region facing a second light-reflecting face of the reflector.

3. A vehicle headlamp having at least one light-emitting diode module, said at least one light-emitting diode module having a reflector and a carrier for light-emitting diodes, and said carrier having at least one surface region on which a number of light-emitting diodes are arranged, wherein said light-emitting diodes are arranged along at least one curved line on said at least one surface region, and wherein the vehicle headlamp has at least three light-emitting diode modules that cooperate to produce the light distribution of the headlight.

4. The vehicle headlamp as claimed in claim 3, wherein the first light-emitting diode module serves for producing a first, widespread light distribution, the second light-emitting diode module serves for producing a second light distribution, focused on to a point, and the third light-emitting diode module serves for producing a third, asymmetric light distribution.

* * * * *